United States Patent [19]

Elias et al.

[11] 4,124,412

[45] Nov. 7, 1978

[54] COLUMBIUM TREATED, NON-AGING, VACUUM DEGASSED LOW CARBON STEEL AND METHOD FOR PRODUCING SAME

[75] Inventors: James A. Elias, Middletown; Rollin E. Hook, Dayton, both of Ohio

[73] Assignee: Armco Steel Corporation, Middletown, Ohio

[21] Appl. No.: 386,158

[22] Filed: Aug. 6, 1973

Related U.S. Application Data

[60] Division of Ser. No. 107,077, Jan. 18, 1971, Pat. No. 3,761,324, which is a continuation-in-part of Ser. No. 15,415, Mar. 2, 1970, abandoned.

[51] Int. Cl.[2] ..... C21D 7/14

[52] U.S. Cl. ..... 148/2; 148/12.3; 148/142

[58] Field of Search ..... 148/2, 3, 12, 12.3, 148/134, 143, 142; 75/49

[56] References Cited

U.S. PATENT DOCUMENTS

| | | | |
|---|---|---|---|
| 3,183,078 | 5/1965 | Ohtake et al. | 75/49 |
| 3,333,987 | 8/1967 | Schrader et al. | 148/2 |
| 3,522,110 | 7/1970 | Shimizu et al. | 148/12 |
| 3,721,587 | 3/1973 | Allten et al. | 148/36 |
| 3,761,324 | 9/1973 | Elias et al. | 148/134 |
| 3,847,682 | 11/1974 | Hook | 148/12.1 |

FOREIGN PATENT DOCUMENTS

| | | | |
|---|---|---|---|
| 1,192,794 | 5/1970 | United Kingdom | 148/2 |

*Primary Examiner*—L. Dewayne Rutledge
*Assistant Examiner*—Peter K. Skiff
*Attorney, Agent, or Firm*—Melville, Strasser, Foster & Hoffman

[57] ABSTRACT

A process of producing non-aging, low carbon steel having substantially no yield point elongation in the annealed condition and freedom from critical grain growth. A molten steel having an analysis typical of steel intended for rimmed or killed drawing steel is vacuum degassed to decarburize to a maximum carbon content of about 0.015%, and columbium (niobium) is added in an amount at least sufficient to combine with the carbon present in the steel. The cast material is hot rolled, finishing at 1500° - 1700° F (about 1090° - 1200° K) and coiled at a temperature of about 1500° F (about 1090° K) or less. The columbium addition retards the rate of recrystallization of the cold rolled product, and a wide spectrum of mechanical properties can be obtained in the final product by control of the final annealing time and temperature within the range of 1000° to 1700° F (about 810° to 1200° K). A preferred product is cold rolled and annealed strip suitable for deep drawing, porcelain enameling, hot dip metallic coating and the like, containing at least about 0.025% uncombined columbium at the hot rolling stage, as determined by analysis at room temperature, which has an average plastic strain ratio of at least 1.8, and a uniform grain size between ASTM 8 and 10.

5 Claims, 10 Drawing Figures

1200°F - 4hr.
100x

1200°F-8hr.
100x

1200° F -
16 hr.
100x

1300° F -
4 hr.
100x

1380°F-8hr.
100x

COLUMBIUM TREATED, NON-AGING, VACUUM DEGASSED LOW CARBON STEEL AND METHOD FOR PRODUCING SAME

CROSS-REFERENCE TO RELATED APPLICATION

This is a division of application Ser. No. 107,077, filed Jan. 18, 1971 now U.S. Pat. No. 3,761,324, which is a continuation-in-part of copending application Ser. No. 15,415, filed Mar. 2, 1970 now abandoned.

BACKGROUND OF THE INVENTION (1) Field of the Invention

The present invention relates to non-aging low carbon, columbium-treated steel having no yield point elongation in the annealed condition, which has excellent surface characteristics and substantial freedom from non-metallic inclusions and a wide spectrum of mechanical properties, and to a method for producing the steel. While the term columbium is used herein, it should be understood that niobium is the same element. Although not so limited, the steel of the present invention in the form of sheet stock has particular utility in deep drawing and stretching operations, in metallic coating processes, and in the production of enameled steel.

(2) Description of the Prior Art

Both carbon and nitrogen give rise to yield point elongation in low carbon steels which have been recrystallization annealed, but strain aging which results in a return of yield point elongation after temper rolling in such steels is usually due to nitrogen. Such strain aging is prevented by adding aluminum which eliminates nitrogen from solution by formation of aluminum nitride. If aluminum stabilized steels are subjected to high temperatures after temper rolling, carbon will cause strain aging unless it also is removed from solid solution. Early workers in the art have stated that elements such as titanium, columbian, vanadium, zirconium, and chromium, if added in sufficient amounts to combine with all the carbon present in the steel, will eliminate aging and yield point elongation. Such elements have a strong affinity for carbon and form stable carbides, thereby removing soluble carbon from ferrite to such a low level that the as annealed yield point elongation is eliminated and strain aging is eliminated as well. The literature has indicated generally that the effectiveness of such elements in preventing aging increases with increasing affinity for carbon in the order — chromium, zirconium, vanadium, columbium and titanium. See *Journal of Iron and Steel Institute,* 142, pages 199–221 (1940); *Iron and Steel,* June 1963, pages 326–334.

Thus, titanium has been considered the most effective element in eliminating aging and yield point elongation in low carbon steels, with columbium considered almost as effective, and other elements such as vanadium and chromium considered somewhat less effective. U.S. Pat. No. 3,183,078, issued May 11, 1965, to T. Ohtake et al., discloses a process for producing non-aging enameling iron having good drawability. This process involves producing a molten steel containing less than 0.04% carbon and an analysis otherwise comparable to conventional rimmed steel (except for a preferred manganese content of 0.05% maximum), vacuum degassing the molten steel to reduce the carbon content to less than 0.02%, less than 0.020% sulfur and 0.002 to 0.007% nitrogen, adding aluminum and titanium in amounts sufficient to combine with the carbon, nitrogen and sulfur present in the steel. In the preferred practice some aluminum is added first in order to combine with residual oxygen and nitrogen, thereby making most of the titanium available for combination with carbon, sulfur and any residual nitrogen not combined with aluminum.

French Pat. No. 1,511,529 granted Dec. 18, 1967, to Yawata Iron and Steel Co. Ltd. (the assignee of the above mentioned U.S. patent) discloses a process similar to that of the U.S. patent for the production of cold rolled sheet stock having good deep drawing and stretching properties. In the process of this French patent a molten steel is subjected to vacuum degassing with the addition of aluminum as a deoxidizing agent to produce a degassed steel containing less than 0.020% carbon and less than 0.015% oxygen. Titanium is added in a weight ratio of 4:1 to the carbon, and the degassed steel is then cast, hot rolled with a finishing temperature above 780° C (1053° K), cold rolled at a reduction rate above 30%, and finally annealed at a temperature between 650° and 1000° C (923° and 1273° K). The resulting sheet stock is stated to have a strong {111} orientation normal to the sheet surface, or cube-on-corner texture, and to have a plastic strain ratio ($r$ value) ranging from about 1.75 to 2.47 depending on the processing used. The ASTM grain size ranges from 7.5 to 10.

The $r$ values set forth in the Yawata French patent are not identified as to which $r$ value is designated. In any event, titanium-bearing steels produced by similar processing by applicants and others in the United States indicate that average $r$ values above about 2.0 cannot be obtained.

In the present application the average plastic strain ratio $r$ is the standard calculated as $$r = \tfrac{1}{4}[r(\text{longitudinal}) + r(\text{transverse}) + 2r(\text{diagonal})].$$

While the addition of titanium to a vacuum degassed steel results in a product having non-aging properties and no yield point, the product nevertheless suffers from a number of disadvantages. Since titanium is a strong nitride, oxide and sulfide former, as well as a carbide former, a larger addition of titanium than the amount theoretically necessary to combine with carbon is required because of the reaction of part of the titanium with nitrogen, oxygen and sulfur present in the steel. Thus, although the theoretical stoichiometric ratio of titanium to carbon is about 4:1, this must be increased initially to a ratio of about 8:1 because titanium reacts with the residual sulfur and nitrogen in the steel. In addition, still more of the titanium is lost as a result of titanium oxide formation which goes into the slag. It has therefore been found that in commercial practice titanium must be added in a weight ratio to carbon of as high as 16:1 in order to obtain a non-aging steel having no yield point. The titanium recovery may thus be on the order of 50 to 60% under such circumstances.

The formation of oxides, nitrides and sulfides of titanium in the steel results in objectionable non-metallic inclusions of these compounds and adversely affects the surface quality of the product.

Titanium in solution in the steel may prevent the healing of hot cracks, as is known to be the case with aluminum.

The great affinity of titanium for oxygen in the air also renders the molten steel less fluid during casting.

Moreover, the titanium bearing steels of the type disclosed in the above mentioned French patent have inherently low strength, not exceeding about 20,000 psi yield strength (138 $MN/m^2$), which cannot be increased substantially by the final annealing treatment.

Due to the above disadvantages and to the increased cost resulting from the practical necessity of adding up to four times the theoretical amount of titanium needed, vacuum degassed, titanium-treated steels have not gained commercial acceptance over rimmed and killed steels for deep drawing, stretching, coating, or enameling applications.

It has previously been reported by Abrahamson et al. in "Transactions Metallurgical Society of AIME", VOl. 218, December 1960, pages 1101 - 1104, that columbium and zirconium substantially retard the rate of recrystallization during annealing of cold rolled material in comparison to alloying elements such as titanium and chromium. These findings were based on one-hour anneals with increasing temperatures throughout each anneal. However, no practical benefit or advantage has ever previously been derived from this knowledge.

SUMMARY

The present invention provides a non-aging low carbon steel having substantially no yield point elongation and freedom from critical grain growth in both the hot rolled and the cold rolled and annealed condition, which avoids the disadvantages of the prior art titanium-bearing steels and moreover exhibits a high degree of near cube-on-corner crystalline orientation, and superior *r* values, and a relatively small grain size which is stable over a broad temperature range. Furthermore the material is producible with a broad spectrum of properties in either the hot rolled or cold rolled conditions. The method of this invention comprises the steps of providing a molten steel having a maximum carbon content of about 0.05% and sufficient manganese to combine substantially completely with the sulfur present in the steel; vacuum degassing the steel to a carbon content of about 0.015% maximum, an oxygen content of about 0.010% maximum, and a nitrogen content of about 0.012% maximum; adding columbium in an amount at least sufficient to retard the recrystallization rate of the steel when subsequently solidified; casting and solidifying the degassed steel; hot rolling the steel to band thickness, finishing at a temperature of about 1500° to 1700° F (about 1090° to 1200° K); and coiling at a temperature of about 1500° F (about 1090° K) or less. The hot rolled product is highly desirable for some applications as coiled or as annealed. Usually the hot rolled product will be pickled and cold reduced to final gauge, followed by a final anneal at a temperature and for a length of time selected to produce a desired strength level and ductility in the finished strip or sheet.

The hot rolled product may be used as coiled or may be subjected to a final anneal within the temperature range of 1350° to 1700° F (about 1005° to 1200° K). The cold rolled product will ordinarily be subjected to a final anneal within the temperature range of 1000° to 1600° F (about 810° to 1145° K). In either case the final anneal may be either batch or continuous, or as incidental but necessary to hot dip metallic coating, and may range from seconds to about 16 hours. For maximum hardness and strength in the hot rolled product the coiling temperature should range between about 940° F and about 1300° F (about 775° and 975° K), and for the cold rolled product the final annealing temperature should be between about 1000° and about 1400° F (about 810° and 1035° K). Conversely, for maximum softness and ductility in the hot rolled product the coiling temperature should range between about 1300° F and about 1500° F (about 775° and 1090° K) and for the cold rolled product the final annealing temperature should be between about 1400° F and about 1600° F (about 1035° and 1145° K).

In its broad range the final product of the present invention has the following composition:

| | |
|---|---|
| carbon | 0.002 to 0.015% |
| columbium* | above 0.025 to 0.30% |
| manganese | 0.05 to 0.60% |
| sulfur | up to 0.035% |
| oxygen | up to 0.010% |
| nitrogen | up to 0.012% |
| aluminum | up to 0.08% |
| phosphorus | residual |
| silicon | residual |
| remainder substantially iron. | |

*Tantalum is commonly present as an impurity in columbium and in small amounts is not undesirable, and will act similarly.

The present invention constitutes a discovery that columbium is unexpectedly superior to titanium both from the processing and product standpoints in a number of significant respects.

For example, applicants have discovered that the previously reported slow recrystallization rate of the columbium-bearing cold rolled steel of this invention permits the attainment of a broad spectrum of mechanical properties if certain processing controls are observed. Recrystallization of the cold rolled structure of the steel of this invention is unlike any other low carbon steel. Recrystallization begins at the strip surfaces and proceeds inwardly such that a banded structure is frequently seen in a partially recrystallized product. Alternatively, the time and temperature of the final anneal may be so selected as to result in substantial recrystallization throughout the strip.

In the process of the present invention, sulfur is combined with manganese, and for this purpose the manganese content preferably is maintained at a weight ratio to sulfur of about 7:1. Aluminum may be added to combine with oxygen and nitrogen, and when so added the weight ratio of aluminum to oxygen is preferably 1.12:1 while the ratio of aluminum to nitrogen is preferably 2:1. Since enough aluminum and manganese are present to combine effectively with sulfur, oxygen and nitrogen, and since columbium has less affinity for oxygen, sulfur, and nitrogen than does aluminum at the temperatures involved, substantially all the columbium added during or after the degassing step and after the aluminum addition is available to combine with carbon. Much higher efficiency results, and columbium recoveries of 75 to 95% are obtainable.

Aluminum may be omitted, or another nitride former such as titanium may be substituted. If a nitride former is omitted, the nitrogen wll be combined with columbium. If tight coil annealing in a nitrogen-hydrogen atmosphere is to be practiced, aluminum should be added since the steel picks up nitrogen from the annealing atmosphere which would combine with columbium if insufficient uncombined aluminum is present thereby resulting in a product having an as annealed yield point elongation if nitrification occurs to the degree that uncombined nitrogen is present. When open coil annealing is to be practiced, this precaution need not be observed.

The use of columbium in place of titanium, the addition of sufficient aluminum to combine with oxygen and nitrogen and the maintenance of sufficient manganese to combine with the sulfur present in the steel result in a material having surface characteristics superior to that of titanium-bearing steel, and the non-metallic inclusions are substantially eliminated in the process of the present invention by removal in the slag. It is well known in the art that titanium-bearing steels contain an objectionable amount of inclusions and have poor surface quality.

The steel of the present invention has consistently higher plastic strain ratios than do titanium-bearing steels similarly processed.

It has been found that high plastic strain ratios are obtained when columbium is added in an amount greater than that required to combine with carbon and any uncombined nitrogen; i.e., when columbium is present in the hot rolled thin bar in uncombined form (apparently in solid solution) a texture is obtained which, after subsequent cold reduction, recrystallizes upon annealing into a final product having a high degree of near cube-on-corner orientation such as {554} and {322}. More specifically, average plastic strain ratios of 1.8 or higher are obtained when at least 0.025% by weight of columbium is present in uncombined form in the hot rolled thin bar, as determined by actual sheet analysis at room temperature.

The steel of the present invention, whether cast in ingot form or continuously cast, can be hot rolled by standard practices and on conventional rolling equipment, thereby assuring low processing and avoidance of capital outlay for new plant equipment.

The atomic weight of columbium is 92.91 and hence the theoretical stoichiometric ratio for complete reaction with the carbon (atomic weight 12.01) present in the steel is about 7.75:1. Titanium has an atomic weight of 47.90 and the theoretical stoichiometric ratio of titanium to carbon is thus about 4:1. It has been found that a columbium to carbon ratio of 10:1, or preferably 12:1, will produce a material which is completely non-aging and which has no yield point elongation. A columbium to carbon ratio of 8:1 may produce a material which has marginal stability in that it might show some yield point elongation under certain annealing conditions. However, a steel which does have some yield point elongation can be subjected to a standard temper rolling step which will eliminate the yield point, and the material will be non-aging because of the low carbon content. Alternatively, such a material could be decarburized after cold rolling, either in a separate step or as an incident to the final recrystallization anneal, to produce complete stability. A steel having a columbium to carbon ratio of less than 8:1 is thus considered within the scope of this invention. In contrast to this, when it is realized that a ratio of titanium to carbon of as high as 16:1 is required in actual practice, because of its reactivity with other elements and the low recovery, despite a theoretical stoichiometric ratio of 4:1, the marked superiority in effectiveness and efficiency of columbium over titanium is apparent.

Although the high cost of columbium would appear at first blush to preclude its use in a low carbon steel for applications such as coating, enameling and the like, applicants have found that the use of columbium results in reduction of processing costs, elimination of some operations, lower rejections and higher yields which more than offset the cost of the columbium addition and the vacuum degassing step.

BRIEF DESCRIPTION OF THE DRAWINGS

Reference is hereby made to the accompanying drawings wherein.

DESCRIPTION OF THE PREFERRED EMBODIMENTS

Figure 1:
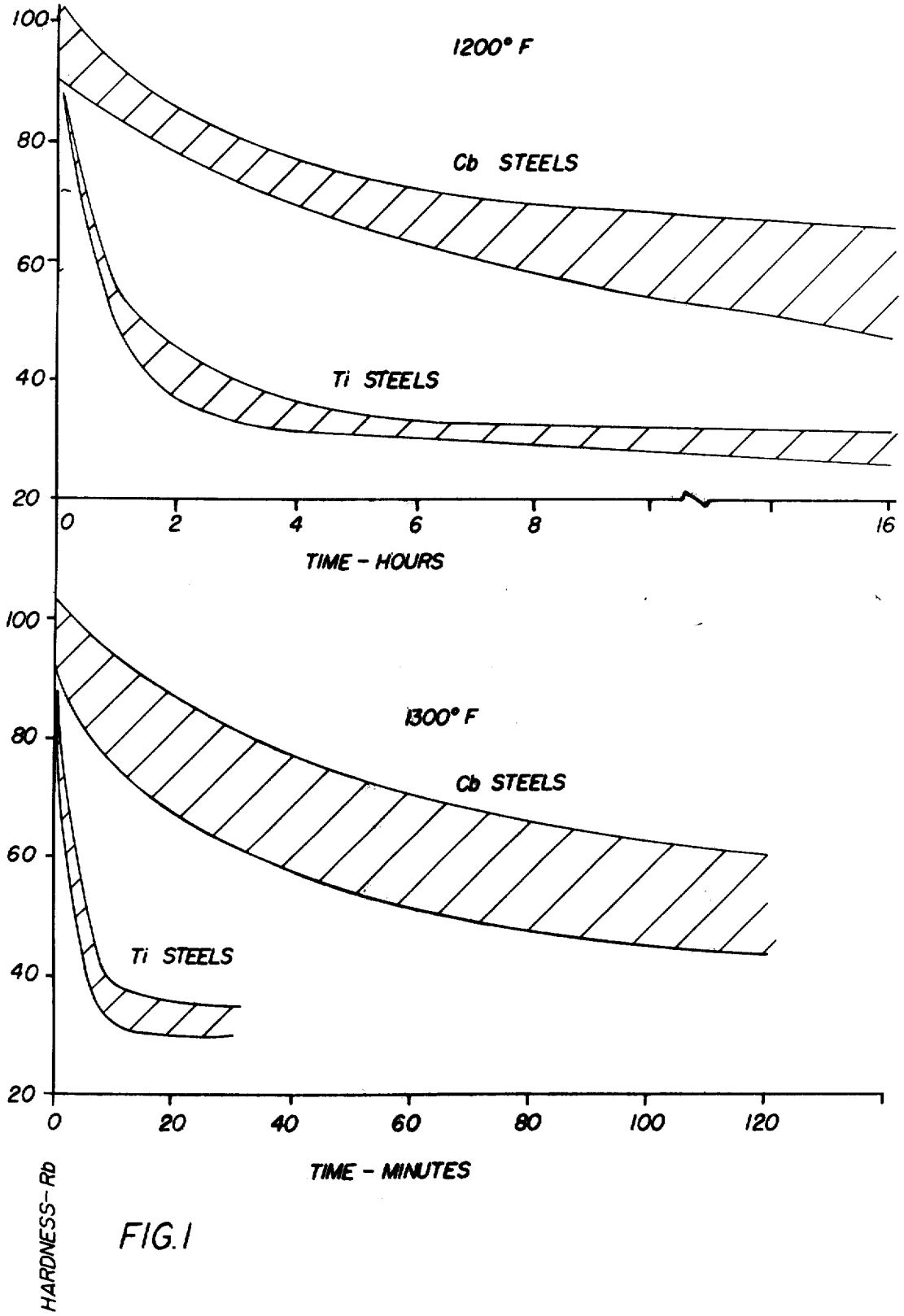
FIG. 1 is a graphic representation of recrystallization response as a function of annealing time and hardness of columbium-bearing steels in comparison with titanium-bearing steels.

A heat of steel may be melted in an open hearth, basic oxygen furnace, or electric furnace, having a typical but non-limiting analysis of steel intended for rimmed or killed drawing steel (0.02 to 0.05% carbon, 0.1 to 0.35% manganese, 0.01 to 0.020% sulfur, 0.001 to 0.010% nitrogen, and balance substantially iron). The molten steel is subjected to decarburization by vacuum degassing in conventional equipment, preferably with argon bubbling to assist in removal of impurities and to avoid temperature stratification. Some aluminum is preferably added before degassing in order to "stun" the heat, i.e., to prevent excessive evolution of gases. Other deoxidants, such as silicon, may also be added in small amounts.

The balance of the aluminum is added preferably during the vacuum degassing but after decarburizing.

The addition of aluminum above the amount necessary to combine with nitrogen and oxygen may not be desirable since it may adversely affect the quality of the final product. More specifically, the presence of excess aluminum in the product may interfere with the healing of hot-short cracks which may be present, although hot-shortness is avoided by ensuring a manganese content high enough to combine substantially completely with the sulfur present in the steel. For this purpose a ratio of manganese to sulfur of about 7:1 should be observed, but higher manganese contents can be tolerated and would not adversely affect the final properties.

Columbium is added after the aluminum, preferably during degassing, or in the ladle or mold if proper distribution means are provided.

A columbium to carbon ratio of 12:1 is preferred in order to ensure complete and permanent removal of carbon by formation of columbium carbide. However, still higher columbium ratios may be utilized, in order to promote grain orientation and desired mechanical properties in the final product.

Silicon is preferably not added, but minor amounts can be tolerated. Other elements in normal residual amounts can also be tolerated.

The degassed steel should have the following preferred analysis, and the composition of the final product will also be substantially the same:

| | |
|---|---|
| carbon | 0.005 to 0.010% |
| columbium | 0.08 to 0.12% |
| manganese | 0.10 to 0.35% |
| sulfur | up to 0.02% |
| oxygen | up to 0.004% |
| nitrogen | up to 0.006% |
| aluminum | 0.015 to 0.020% |
| phoshorus | up to 0.010% |
| silicon | up to 0.015% |
| remainder substantially iron, except for incidental impurities. | |

The degassed and treated steel may then be cast into ingot molds, or may be strand cast by conventional practices.

Where continuous hot rolling is to be practiced, the ingots are reduced to slab thickness, reheated if necessary, hot rolled to band thickness, and coiled.

A conventional hot band finishing temperature of 1500° to 1700° F (about 1090° to 1200° K) is preferred and is not critical in the practice of the present invention. However, a finishing temperature below about 1500° F (about 1090° K) results in higher power requirements, and it is more difficult to obtain the desired thickness. A finishing temperature substantially above about 1700° F (about 1200° K) requires higher rolling speeds, and a thicker and hotter bar is sent into the finishing stands.

A rapid quench to a coiling temperature between about 1100° and 1300° F (about 865° and 975° K) is preferred although higher or lower coiling temperatures extending to the practical limits may be practiced. In general, coiling at higher temperature (i.e., up to 1500° F or about 1090° K) results in a softer product, while coiling at lower temperatures (i.e., down to 940° F or about 775° K) results in a harder product. Quenching to such low coiling temperatures is difficult to achieve on existing equipment.

As an adjunct or alternative to coiling at a relatively high temperature, a continuous or batch anneal of the hot rolled band can be carried out at a temperature up to about 1750° F (about 1230° K) in order to obtain a hot rolled product having the maximum degree of softness and ductility.

The coiled material is then pickled and cold rolled substantially to final gauge, preferably without intermediate annealing, in accordance with conventional practice. The cold reduction may be on the order of 60% to 70% and does not constitute a limitation on the process of the invention. Higher degrees of cold reduction up to 90% result in higher *r* values.

The cold rolled strip is then subjected to a final anneal in a protective atmosphere, which may be either continuous or batch.

It will be understood that the hot rolled band or thin bar is a product which is sold commercially, and its properties are dependent on the composition of the steel and the coiling temperature, i.e. the rate of cooling from the finishing temperature to the coiling temperature and the degree of annealing which occurs in the compact coil as it cools slowly. Unlike conventional low carbon or titanium-treated steels, the hot rolled product can be produced with a wide spectrum of mechanical properties ranging from high strength and hardness to moderate and low strength and accompanying high ductility. Of course the plastic strain ratio will be substantially 1.0, as for any hot rolled, low carbon steel.

Table IA below illustrates the range of mechanical properties of 0.100 inch (2.54 mm) thick hot rolled thin bar produced in an experimental mill processed 160 ton (145 metric ton) open hearth melted and vacuum degassed heat containing 0.11% columbium and 0.005% carbon (columbium:carbon ratio of 22:1). Table IB below illustrates the range of mechanical properties of 0.077 inch (1.96 mm) thick hot rolled thin bar produced in an experimental mill processed 170 ton (154 metric ton) electric furnace melted and vacuum degassed heat containing 0.14% columbium and 0.008% carbon (Cb:C ratio of 17:1). Quenching from the hot rolling finishing temperature of about 1600° F (about 1145° K) to a low coiling temperature of 1100° F (about 865° K) or below results in a fine dispersion of columbium carbide precipitates which contribute to the high strength and hardness developed in the hot rolled product, while the employment of higher coiling temperatures, from 1300° to 1500° F (about 975° to 1090° K) results in a coarser dispersion of these precipitates and lower strength and hardness.

TABLE IA

Hot Rolled Thin bar (0.100" or 2.54 mm thick)
Mill Produced and Processed Steel
Containing 0.11% Columbium and 0.005% Carbon

| Coiling Temp. | | Hardness | Tensile Strength | | Yield Strength | | % Elong. |
|---|---|---|---|---|---|---|---|
| °F | °K | $R_B$ | ksi | MN/m² | ksi | MN/m² | in 2" |
| 1100 | 865 | 63 | 53.2 | 367 | 38.0 | 262 | 35 |
| 1300 | 975 | 55 | 48.5 | 334 | 31.0 | 214 | 42 |
| 1500 | 1090 | 45 | 46.0 | 318 | 26.0 | 179 | 47 |

TABLE IB

Hot Rolled Thin Bar (0.077" or 1.96 mm thick)
Mill Produced and Processed Steel
Containing 0.14% Columbium and 0.008% Carbon

| Coiling Temp. | | Hardness | Tensile Strength | | Yield Strength | | % Elong. |
|---|---|---|---|---|---|---|---|
| °F | °K | $R_B$ | ksi | MN/m² | ksi | Mn/m² | in 2" |
| 940 | 775 | 76 | 67.8 | 468 | 48.7 | 336 | 25 |
| 1100 | 865 | 75 | 65.0 | 449 | 46.2 | 319 | 30 |
| 1300 | 975 | 60 | 52.6 | 364 | 31.1 | 214 | 40 |

Regardless of the strength and hardness produced by quenching from the finishing temperature to a low coiling temperature, the hot rolled band can be rendered soft and ductile by post annealing. If the band is annealed in the ferritic range (below the $A_1$ temperature of about 1670° F or 1183° K), no grain growth occurs, but the columbium carbide precipitates are coarsened, and a softer and more ductile product is produced. Annealing somewhat above the austenitization temperature results in a coarser grained transformed ferrite and an even softer product than can be obtained by annealing at a temperature in the ferritic range. Table IIA below illustrates the effect of such post annealing temperatures on hot rolled material which had been coiled at 1100° F (about 865° K).

TABLE IIA

| Post Annealed Hot Rolled Thin Bar (0.100" or 2.54 mm thick) Mill Produced and Processed Steel Containing 0.11% Columbium and 0.005% Carbon | | | | | | | |
|---|---|---|---|---|---|---|---|
| Post Anneal Condition | Grain Size ASTM | Hardness $R_B$ | Tensile Strength ksi | Tensile Strength $MN/m^2$ | Yield Strength, ksi | Yield Strength, $MN/m^2$ | % Elong. in 2" |
| Continuous Strip Anneal in Ferritic Range (1600° F-1145° K) | 8-9 | 46 | 46.0 | 317 | 25.0 | 172 | 47 |
| Continuous Strip Anneal above Austenitization Temperature (1700° F-1200° K) | 5-6 | 40 | 41.0 | 283 | 24.0 | 166 | 49 |

The sluggish response in softening of the steels of the invention makes it possible to retain the hot rolled properties after hot dip metallic coating, even where the hot rolled band is subjected to relatively high temperatures, such as 1350° F (about 1005° K), for a short time, as in aluminum coating. This is illustrated in Table IIB below, where material having a columbium to carbon ratio of 17:1 was coiled at 940° F (about 780° k). (The properties before coating are given in Table IB above.)

TABLE 11B

| Aluminum-Coated Hot Rolled Thin Bar (0.77" or 1.96 mm thick) Mill Produced and Processed Steel Containing 0.14% Columbium and 0.008% Carbon | | | | | | |
|---|---|---|---|---|---|---|
| Condition | Hardness $R_B$ | Tensile Strength ksi | Tensile Strength $MN/m^2$ | Yield Strength ksi | Yield Strength $MN/m^2$ | % Elong. in 2" |
| As Coated (1350° K or 1005° K Strip Temperture) | | | | | | |
| Stretch and Roller Leveled | 74 | 65.0 | 449 | 54.0 | 373 | 20 |

The hot rolled band or thin bar of the present invention does not exhibit yield point elongation and hence is not subject to coil breaking during winding onto or unwinding from a mandrel. Hence the hot rolled band can be hot dip metallic coated on continuous coating lines without coil breaks; this has been practically impossible with steels of the prior art. The coated strip can be roller- or stretcher-leveled to produce a high degree of flatness without undergoing fluting or stretcher strains. The steel does not exhibit stretcher strains during forming, which can cause breakage and/or poor surface appearance in conventional low carbon steels.

In the cold rolled and annealed strip a wide spectrum of properties can be produced ranging from high strength with limited ductility to moderate strength with high ductility and high $r$ values, which are required for good deep drawability. The properties of the strip are dependent on composition, rate of cooling from the finishing temperature in the hot rolling process, and on annealing conditions.

In the columbium-treated steels of the present invention the rate of recrystallization during the final anneal proceeds so slowly with time at annealing temperatures of 1100° to 1400° F (about 865° to 1035° K) that the properties can be controlled in a practical manner in existing steel production annealing facilities. The retardation of the recrystallization response is substantially greater than in any low carbon ferritic steel, either rimmed, aluminum-killed or titanium-treated. The graph of FIG. 1 illustrates the recrystallization response, as a function of decrease in hardness, with time at annealing temperatures of 1200° F and 1300° F (about 920° and 975° K) for columbium-treated and titanium-treated steels.

Moreover, the formation of columbium carbide precipitates provides inherent strengthening of the steel which can also be controlled by proper selection of the final annealing conditions. Table III illustrates the spectrum of tensile and yield strengths which are developed by annealing at 1200° F (about 920° K) and 1300° F (about 975° K), respectively, a mill produced 160 ton (145 metric ton) open hearth heat containing 0.11% columbium and 0.005% carbon, vacuum degassed, poured into ingot molds, hot rolled to 0.100 inch (2.54 mm) thickness, coiled at 1300° F (about 975° K) and cold reduced 65%.

TABLE III

| Spectrum of Properties Developed on Annealing | | | | | | | | | | |
|---|---|---|---|---|---|---|---|---|---|---|
| | 1200° F (920° K) | | | | | 1300° (975° K) | | | | |
| Annealing Time - Hrs. | T.S. ksi | T.S. $MN/m^2$ | 0.5% Y.S. ksi | 0.5% Y.S. $MN/m^2$ | % Elong. in 2" | T.S. ksi | T.S. $MN/m^2$ | 0.5% Y.S. ksi | 0.5% Y.S. $MN/m^2$ | % Elong. in 2" |
| 1 | 71.3 | 492 | 67.2 | 464 | 10.5 | 49.2 | 340 | 27.7 | 191 | 39.7 |
| 2 | 68.2 | 470 | 62.6 | 433 | 14.2 | 47.0 | 324 | 24.0 | 166 | 43.8 |
| 4 | 58.2 | 402 | 48.0 | 332 | 21.2 | 46.2 | 318 | 21.0 | 145 | 45.6 |
| 16 | 53.6 | 370 | 40.0 | 276 | 29.2 | 45.4 | 313 | 20.2 | 139 | 48.2 |

Yield Point Elongation = 0%, all conditions.

The properties developed by annealing following cold reduction are related to and dependent on the strength and hardness of the hot rolled band or thin bar. The greater the hardness exhibited by the hot rolled thin bar before cold reduction, the greater will be the strength exhibited by the annealed strip for any given annealing condition. Hot rolled thin bar processed to exhibit less than maximum hardness, e.g. by coiling at a relatively high temperature (e.g. 1300° F — about 975° K or above) or by post annealing, will have more moderate strength and greater ductility after cold reduction and annealing. The effect of thin bar hardness on mechanical properties after cold reduction and annealing is shown in Table IV, for an experimental mill-produced heat having a columbium:carbon ratio of 22:1.

TABLE IV

EFFECT OF HOT ROLLED THIN BAR HARDNESS ON COLD ROLLED AND ANNEALED PROPERTIES

| Time | 1200° F Anneal (920° K) | | | | | | | | | 1300° F Anneal (975° K) | | | | | | | | |
|---|---|---|---|---|---|---|---|---|---|---|---|---|---|---|---|---|---|---|
| | T.S. - Ksi | | | 0.5% Y.S. - Ksi | | | % Elong. in 2 in. | | | T.S. - Ksi | | | 0.5% Y.S. - Ksi | | | % Elong. in 2 in. | | |
| Hrs. | A | B | C | A | B | C | A | B | C | A | B | C | A | B | C | A | B | C |
| 1/6 | | | | | | | | | | 71.1 | 64.2 | 56.3 | 61.8 | 55.1 | 43.6 | 15.2 | 16.4 | 25.1 |
| 1/2 | | | | | | | | | | 60.7 | 54.0 | 48.8 | 45.8 | 35.9 | 27.3 | 26.9 | 31.5 | 37.4 |
| 1 | 77.4 | 71.3 | 63.4 | 71.6 | 67.2 | 57.3 | 11.5 | 10.5 | 15.2 | 51.0 | 49.2 | 46.1 | 28.9 | 27.6 | 20.7 | 36.2 | 39.7 | 43.2 |
| 2 | 75.8 | 68.2 | 60.8 | 69.1 | 62.6 | 52.9 | 11.5 | 14.2 | 21.0 | | | | | | | | | |
| 4 | 71.0 | 58.2 | 52.5 | 61.1 | 48.0 | 37.1 | 15.2 | 21.2 | 31.5 | 47.4 | 46.2 | 44.5 | 22.8 | 21.0 | 18.9 | 43.3 | 45.6 | 46.7 |
| 8 | 67.2 | 57.6 | 51.0 | 54.0 | 44.8 | 33.9 | 18.1 | 23.5 | 35.0 | | | | | | | | | |
| 16 | 61.5 | 53.6 | 49.3 | 46.5 | 39.9 | 29.5 | 23.4 | 29.2 | 39.7 | 46.0 | 45.4 | 44.5 | 21.1 | 20.2 | 18.7 | 43.9 | 48.5 | 47.1 |

% YPE = 0, all conditions

Thin Bar Hardness - $R_B$

A 66 Coiled 1100° F (about 810° K), cold reduced 65%, annealed

B 55 Coiled 1300° F (about 975° K), cold reduced 65%, annealed

C 42 Coiled 1300° F (about 975° K), annealed 1600° F (about 1145° K), cold reduced 65%, annealed.

Note - To obtain $MN/m^2$, multiply by 6.9

Figure 2:
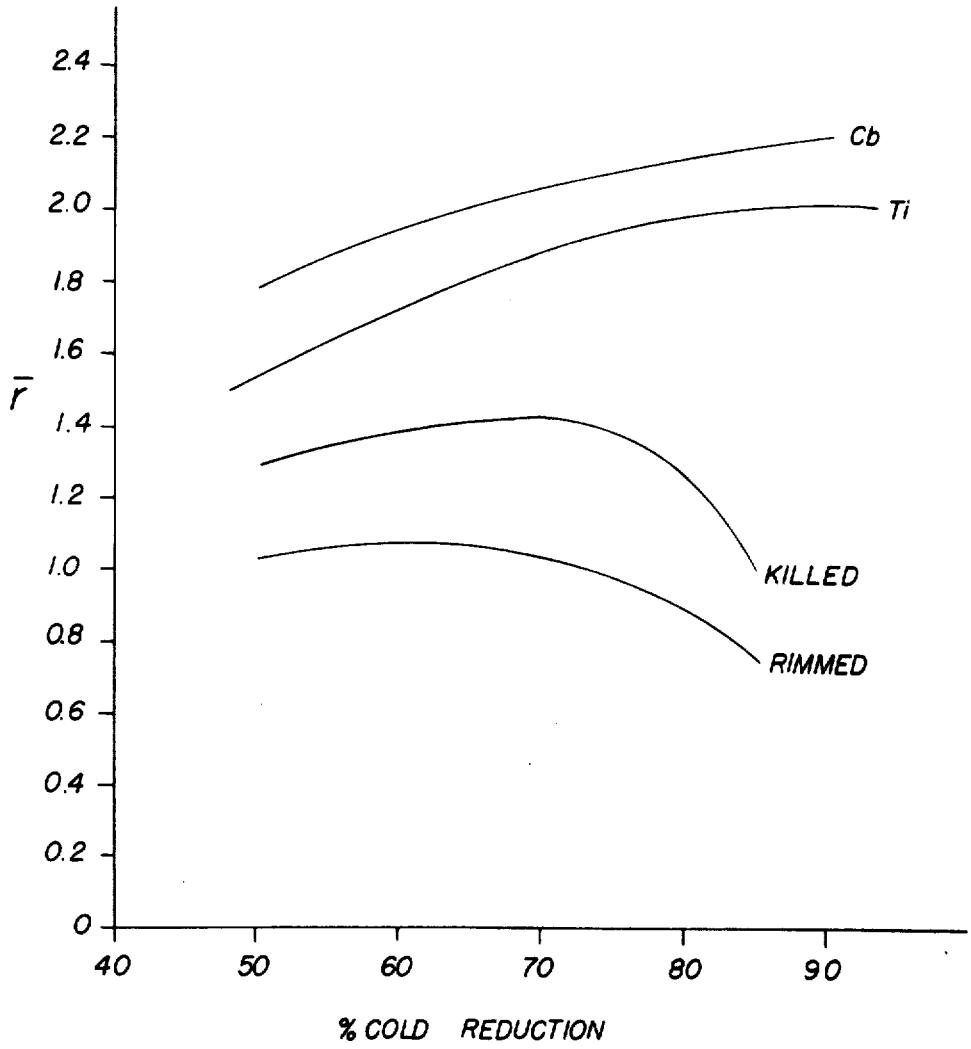
FIG. 2 is a graph showing the relationship between *r* and percent cold reduction for rimmed, aluminum killed, titanium and columbium treated steels.

The effect of cold reduction on the plastic strain ratio is graphically illustrated in FIG. 2 where a steel of this invention having a columbium to carbon ratio of 17:1 is compared to a titanium-treated steel and to conventional aluminum-killed and rimmed steels. The superiority in *r* values of the steel of the invention, within the cold reduction range of 50% to 90%, is apparent.

The previously discussed sluggish softening response in steels of the present invention provides potential for the production of full hard metallic coated strip which has heretofore been impossible to produce with aluminum coatings. A full hard product is one having cold reduced properties such as a yield strength of 90 ksi (621 $MN/m^2$) or higher as coated. During metallic coating the strip is usually heated to 1250° F (about 950° K) or higher to clean the surface and to bring it to the coating temperature. Prior art rimmed, killed or titanium-treated steels recrystallize very rapidly at temperatures near 1200° F (about 920° K) and thus lose full hard properties. The alloy of this invention can be annealed for short times at temperatures of about 1250° F (about 950° K) without substantial recrystallization or softening. Therefore, the desired properties are obtained while using a temperature at which good cleaning and coating adherence can be ensured.

Figure 3:
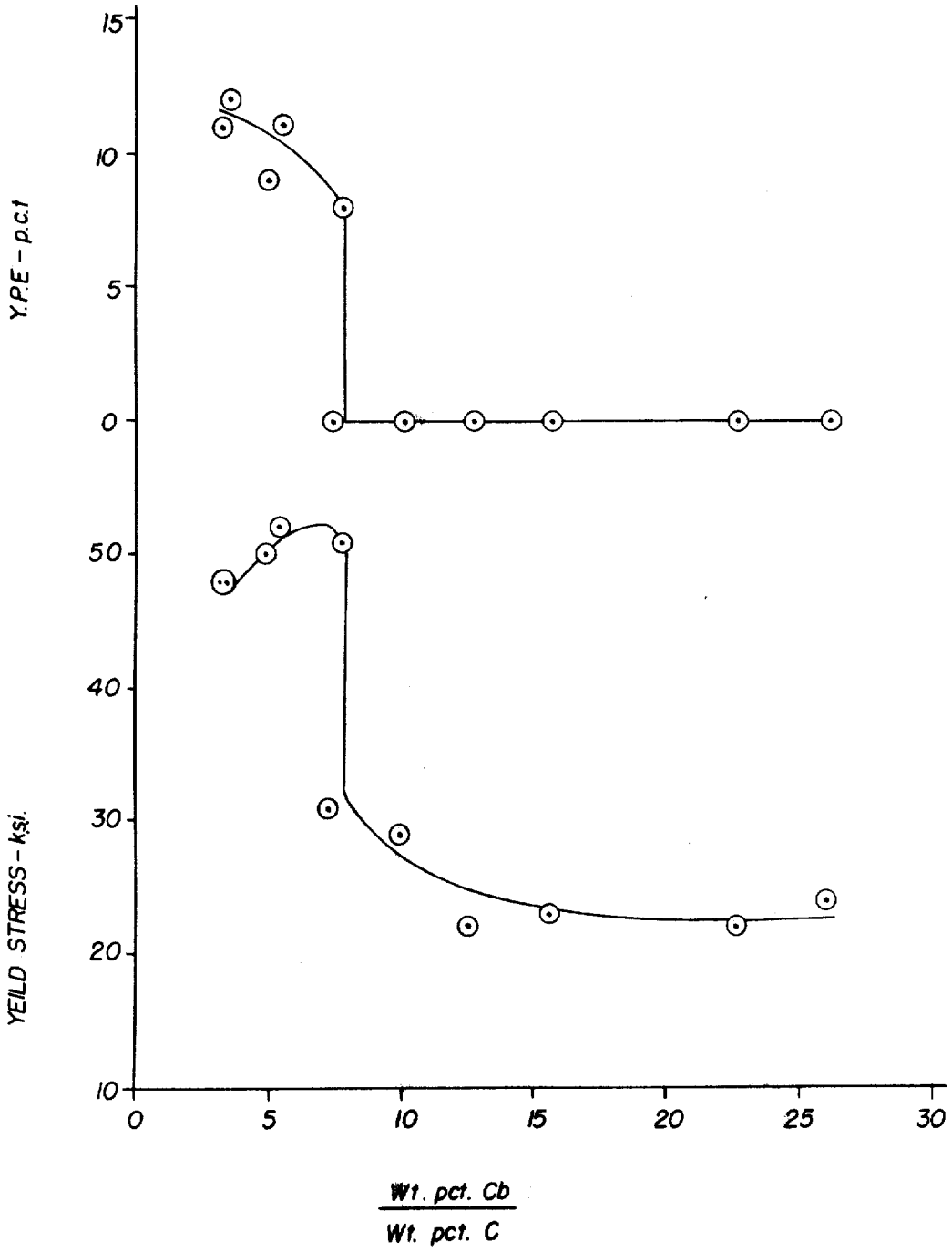
FIG. 3 is a graph showing the effect of varying columbium to carbon ratios on yield point elongation and yield stress.

The effect of composition on the yield strength and freedom from yield point elongation in the as annealed condition is graphically illustrated in FIG. 3. The data plotted on the graph of FIG. 3 were obtained from laboratory-produced and processed heats. The heats were vacuum melted and all heats contained about 0.010% carbon by weight. The material was hot rolled to simulate commercial controlled grain practice, with a finishing temperature of 1600° F (about 1145° K) and a coiling temperature of 1100° F (about 865° K). The hot rolled band was cold reduced 60% and annealed at 1380° F (about 1020° K) for 1 hour to produce fully recrystallized cold rolled sheet. It is apparent from FIG. 3 that in steels of the specified carbon content which have been subjected to the process of the present invention, a columbium to carbon ratio of 8:1 or greater renders the steels free of yield point elongation even when sulfur, oxygen and nitrogen are present. Since the stoichiometric ratio of columbium to carbon in columbium carbide is 7.75:1, the graph of FIG. 3 illustrates the high efficiency and effectiveness of columbian in combining selectively with carbon and removing carbon from solution.

Annealing conditions also affect yield point elongation of laboratory-produced steels within the range of columbium to carbon ratios of about 7:1 to 10:1. Thus, in a laboratory-produced steel having a columbium:carbon ratio of about 7:1, annealing at 1300° F (about 975° K) produced transient instability for an annealing time up to about 8 hours, but continuation of the anneal up to 16 hours resulted in reducing the yield point elongation back to a value of less than 1%. On the other hand, annealing at temperatures in the range of 1400° to 1600° F (about 1035° to 1145° K) resulted in both transient and persistent types of instability for annealing times up to 16 hours.

In a laboratory-produced steel having a columbium to carbon ratio of 10:1, annealing within the temperature range of 1400° to 1500° F (about 1035° to 1090° K) produced temporary instability for an annealing time of about 2 hours, but when continued for a time up to 8 hours, the yield point elongation was reduced to a value of 0%. On the other hand, annealing at 1600° F (about 1145° K) produced both transient and persistent instability for annealing times up to 9 hours.

In contrast to this, in a laboratory-produced steel having a columbium to carbon ratio of about 12.5:1, the material was completely and permanently free of yield point elongation under annealing conditions ranging from temperatures of 1300° F to 1600° F (about 975° to 1145° K) for times of 5 minutes to 16 hours.

Transient instability may only be a phenomenon found in laboratory produced materials, probably as a result of the relatively rapid cooling on ingots and hot bands which results in very fine carbide precipitates. Such a phenomenon has not been found in a mill produced heat with a marginal columbium to carbon ratio.

The presence of a yield point elongation in steels having a columbium to carbon ratio in the range of 7:1 to 10:1 at annealing temperatures of 1500° to 1600° F (about 1090° to 1145° K) would minimize the value of this invention for use of such material in hot dip continuous coating with aluminum or zinc, since such a coating process involves annealing for a short time at temperatures between 1350° and 1600° F (about 1005° and 1145° K). However, as indicated previously, the material can be temper rolled to eliminate the yield point elongation, and the product would thereafter be non-aging.

Figure 4:
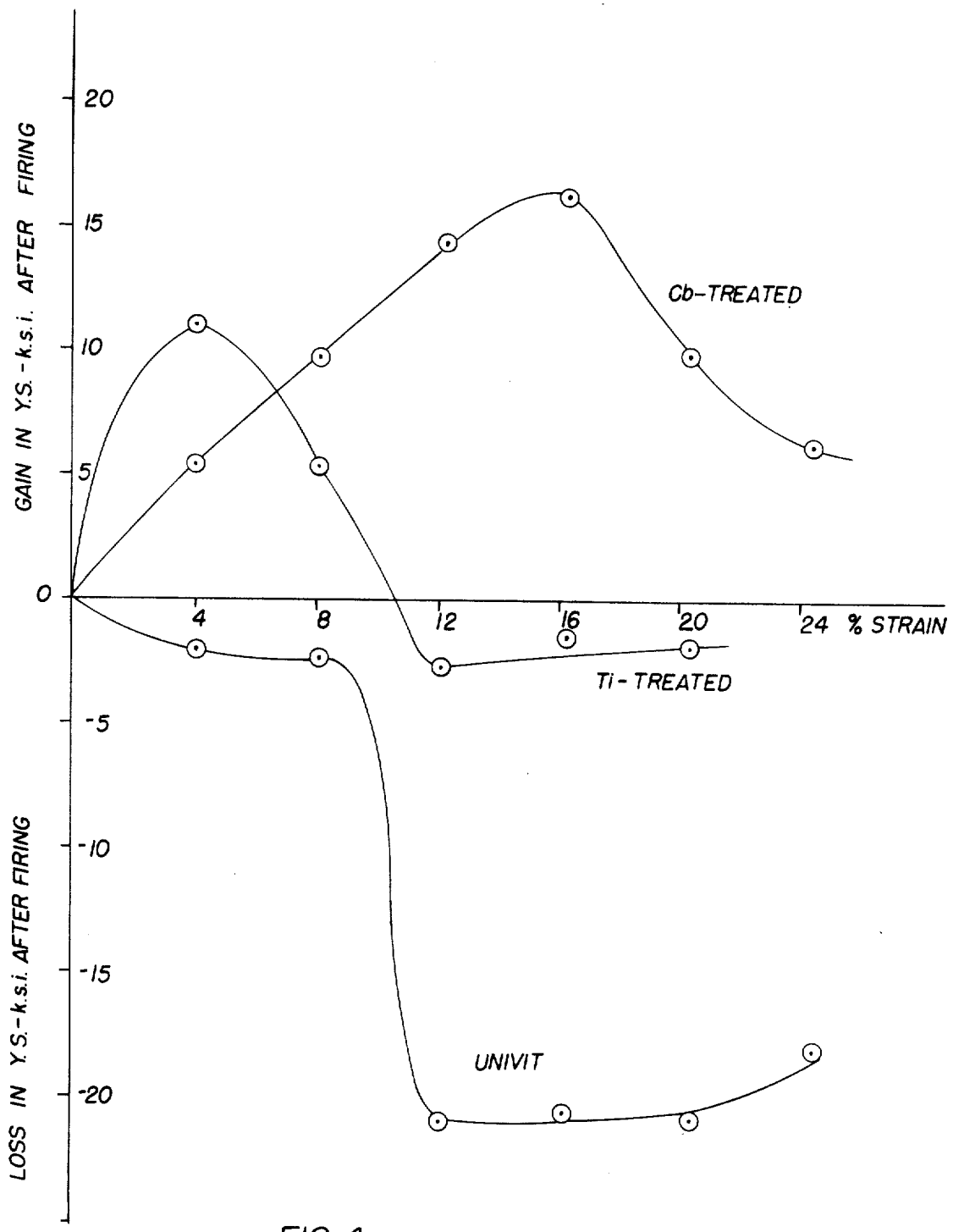
FIG. 4 is a graphic comparison of yield strengths of columbium bearing steel of the invention with titanium-bearing steel and a commercial grade enameling steel after straining and firing.

One of the most significant properties of the steel of the present invention is freedom from critical grain growth, which makes the material particularly useful for enameling steel. The firing of porcelain enamel-coated drawn parts results in critical grain growth when conventional or titanium-treated steels are used, and this has been a problem of long standing. Critical grain growth results in an extreme loss in strength because of the large ferrite grain size which develops along the critically strained regions of a drawn part in the annealing which occurs as a result of firing the applied frit. Applicants have found that the columbium-treated steels of the present invention not only show freedom from critical grain growth but even show enhanced strength as a result of critical straining of the drawn parts. Table V and FIG. 4 compare an experimental columbium-bearing mill produced heat of the steel of the present invention with a titanium-bearing enameling steel of the composition disclosed in the above mentioned U.S. Pat. No. 3,183,078, and a standard commercially available grade of enameling steel sold under the registered trademark UNIVIT. The columbium-treated steel is the same heat as that described in Table III above. The graph of FIG. 4 shows that the steel of the present invention gradually increases in strength with increasing degrees of strain up to 16% and never decreases to the original strength, while the titanium-treated steel increases in strength when strained up through 8% but exhibits a loss in strength below the original strength when strained 12% or more. The commercial enameling steel exhibits a loss in strength as a result of even the slightest degree of strain. Moreover, Table V shows that the grain size of the steel of the present invention remains constant even when strained beyond 16%.

TABLE V

| | Critical Grain Growth After Firing at 1450° F (about 1060° K) for 5 Minutes | | | | | | | | | | | |
|---|---|---|---|---|---|---|---|---|---|---|---|---|
| | Cb-Treated Mill Produced Steel | | | | Ti-Treated Steel | | | | Armco UNIVIT Grade Enameling Steel | | | |
| % Strain Before Firing | Y.S. — ksi | Y.S. — MN/m² | % YPE | ASTM Grain Size | Y.S. — ksi | Y.S. — MN/m² | % YPE | ASTM Grain Size | Y.S. — ksi | Y.S. — MN/m² | % YPE | ASTM Grain Size |
| 0 | 19.4 | 134 | 0 | 8 | 17.0 | 117 | 0 | 8-9 | 34.6 | 238 | 8.0 | 8-9 |
| 4 | 24.7 | 170 | 0 | 8 | 22.6 | 156 | 0 | 8-9 | 32.6 | 225 | 4.2 | 8-9 |
| 8 | 29.2 | 202 | 0 | 8 | 27.9 | 192 | 0 | 8 | 32.3 | 223 | 2.5 | 8-9 |
| 12 | 33.8 | 233 | 0 | 8 | 14.2 | 98 | 0 | 1-2 | 13.6 | 94 | 0 | 1 |
| 16 | 35.6 | 246 | 0 | 8 | 15.5 | 107 | 0 | 1-3 | 14.0 | 97 | 0 | 2-3 |
| 20 | 29.2 | 202 | 0 | 8 | 15.0 | 103 | 0 | 3-4 | 13.7 | 95 | 0 | 3-4 |
| 24 | 25.6 | 177 | 0 | 8 | | | | | 16.5 | 114 | 0.8 | 4-5 |

A preferred columbium treated steel of the present invention, containing 0.11% columbium and 0.005% carbon was processed through the hot rolling and coiling stages and then subjected to a variety of subsequent operations. The mechanical properties are set forth in Table VI below. It is significant to note that comparable strengths and elongation and high $r$ values can be obtained on cold reduced sheet by both batch annealing and hot dip metallic coating. The coated hot rolled product can be produced with the same strengths and high elongation values as are obtained with cold rolled, batch annealed and/or coated products.

TABLE VI

| | Mill Produced Drawing Quality Steel Containing 0.11% Columbium and 0.005% Carbon | | | | | | |
|---|---|---|---|---|---|---|---|
| Condition | Hardness $R_B$ | .5% Yield Strength- ksi | .5% Yield Strength- MN/m² | Tensile Strength- ksi | Tensile Strength- MN/m² | % Elong. in 2" | $\bar{r}$ |
| Open coil annealed at 1380° F (about 1020° K) - 8 hrs. after 65% cold reduction to 20 gauge, then .2% temper rolled for flatness | 41 - 44 | 21.0 - 2.00 | 145 - 152 | 45.0 - 46.0 | 310 - 315 | 45 - 48 | 1.95 - 2.10 |
| Box annealed at 1375° F (about 1020° K) - 12 hrs. after 65% cold reduction to 20 gauge, then .2% temper rolled for flatness | 39 | 20.0 - 21.0 | 138 - 145 | 45.0 | 310 | 44 | 2.1 |
| Zinc coated after 70% cold reduction to 22 gauge; strip temp. 1500° - 1600° F (about 1090° - 1145° K) | 40 | 22.0 - 23.0 | 152 - 159 | 46.0 - 47.0 | 314 - 324 | 40 - 41 | 1.78 |
| Zinc coated after .104" (26.4 mm) hot rolled band; strip temp. 1500° - 1600° F (about 1090° - 1145° K) | 43 - 47 | 22.0 - 25.0 | 152 - 172 | 44.0 - 45.0 | 304 - 310 | 45 - 47 | 1.0 |

Yield Point Elongation = 0%, all conditions.

Figure 10:
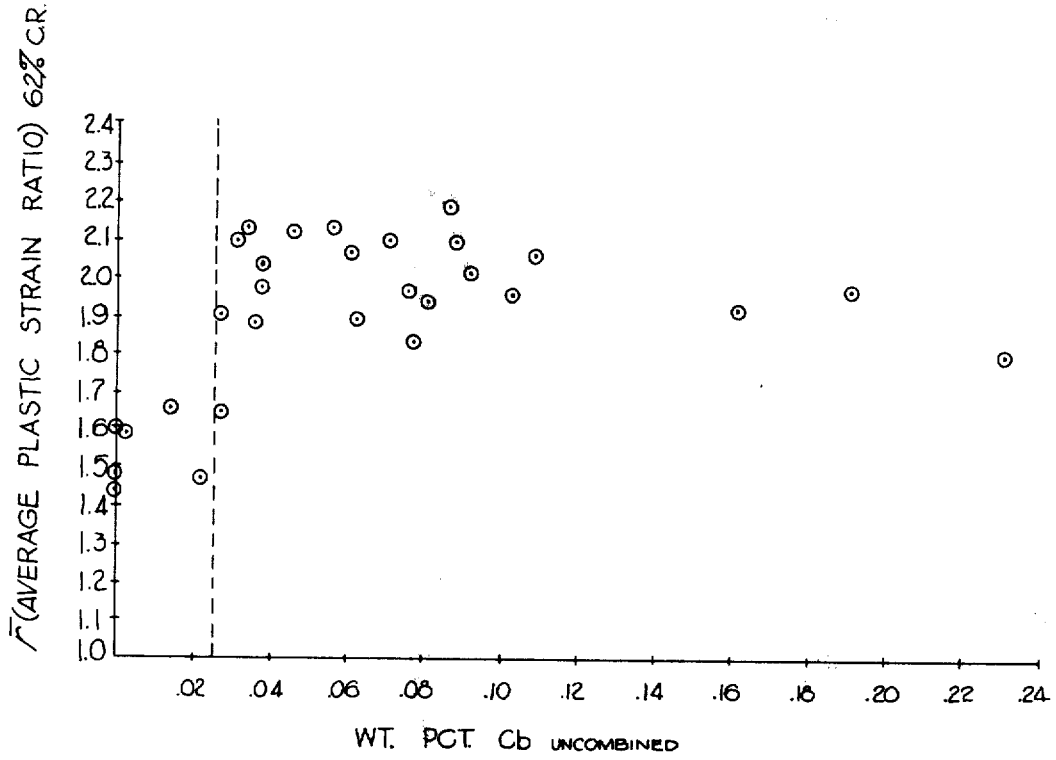
FIG. 10 is a graph showing the relationship between *r* and the amount of uncombined columbium present in the hot rolled product.

The correlation between average plastic strain ratio and the amount of uncombined columbium in the hot rolled thin bar is graphically illustrated in FIG. 10. Data were obtained from a number of continuously-cast heats and from a number of ingot heats, each type being subjected to the same processing conditions. The ingots or slabs were hot rolled with a finishing temperature of 1650° F (1170° K) and coiled at 1200° F (920° K). The hot rolled thin bar ranged between 0.090 and 0.100 inch (2.29 and 2.54 mm) in thickness.

The columbium, carbon and aluminum contents were intentionally varied in these heats, while the remaining elements were maintained constant within commercially practicable limits. More specifically, the total columbium contents were varied between about 0.068% and 0.25%, carbon between 0.0022% and 0.020%, and aluminum between less than 0.002% and 0.070%. Other elements were within the following ranges:

| | |
|---|---|
| manganese | 0.3 - 0.5% |
| sulfur | 0.008 - 0.019% |
| oxygen | 0.001 - 0.01% |
| nitrogen | 0.004 - 0.008% |
| phosphorus and silcon residual | |
| remainder substantially iron | |

The amount of uncombined columbium was calculated by either of the following two formulae, depending upon whether or not aluminum was added to combine with nitrogen:

$$\%\,Cb_{uncomb.} = \%\,Cb_{total} - 7.75\%\,C_{total} - 6.65\left[\%\,N_{total} - \frac{\%\,Al_{acid\,sol.}}{1.93}\right] \quad 1.$$

$$\text{where}\left[\%\,N_{total} - \frac{\%\,Al_{acid\,sol.}}{1.93}\right] > 0$$

$$\%\,Cb_{uncomb.} = \%\,Cb_{total} - 7.75\%\,C_{total} \quad 2.$$

$$\text{where}\left[\%\,N_{total} - \frac{\%\,Al_{acid\,sol.}}{1.93}\right] \leqq 0$$

If titanium is used as a nitride former rather than aluminum, these formulae can be appropriately modified to account for this substitution.

In FIG. 10 $\bar{r}$ values are for the final product after 62% cold reduction and annealing at 1375° F (1020° K), while the percentages of uncombined columbium are calculated by formulae 1 and/or 2 using percentage values of total columbium, total carbon, total nitrogen and acid-soluble aluminum for the hot rolled thin bar, as determined by sheet analysis at room temperature. It will of course be understood that the actual percent of uncombined columbium, or columbium in solid solution, at the hot rolling temperature will not be the same as that analyzed at room temperature. However, it has been found that there is a well defined relationship between $\bar{r}$ and the uncombined Cb determined at room temperature.

As will be apparent from FIG. 10, a marked difference in $\bar{r}$ values occurs between about 0.022% and about 0.026% uncombined columbium, and the critical value thus appears to be about 0.025% uncombined columbium, above which F values in excess of 1.8 can be obtained. One heat, having 0.027% uncombined columbium, exhibited an $\bar{r}$ value of only 1.65, and this exception to all the other data is not at present explainable.

Variations in total carbon, aluminum and nitrogen contents were found to have relatively little effect on $\bar{r}$ values, provided sufficient columbium is added to provide an excess of at least about 0.025% uncombined columbium, as determined in the hot rolled product, as will be apparent from a consideration of Table VII below.

TABLE VII

| % $Cb_{uncomb.}$ | $\bar{r}$ | Total % Cb | Total % C | Total % N |
|---|---|---|---|---|
| | % Al > 1.93% N + 1.12% O | | | |
| by formula 2 | | | | |
| .071 | 2.10 | .095 | .0031 | .0063 |
| .076 | 1.97 | .098 | .0028 | .0048 |
| .057 | 2.13 | .079 | .0029 | .0055 |
| .109 | 2.06 | .15 | .0053 | .0053 |
| .087 | 2.19 | .12 | .0043 | .0057 |
| .061 | 2.07 | .083 | .0029 | .0068 |
| .036 | 1.89 | .091 | .0069 | .0063 |
| .191 | 1.97 | .24 | .0063 | .0056 |
| .089 | 2.10 | .11 | .0027 | .0050 |
| .103 | 1.96 | .12 | .0022 | .0053 |
| .081 | 1.94 | .13 | .0063 | .0051 |
| .062 | 1.90 | .094 | .0041 | .0056 |
| .231 | 1.80 | .25 | .0025 | .0070 |
| .092 | 2.02 | .11 | .0023 | .0058 |
| .078 | 1.84 | .11 | .0042 | .0064 |
| .027 | 1.65 | .068 | .0053 | .0069 |
| 0 | 1.60 | .14 | .020 | — |
| | % Al < 1.93% N + 1.12% O | | | |
| by formula 1 | | | | |
| .047 | 2.12 | .096 | .0038 | .0050 |
| .038 | 1.97 | .091 | .0027 | .0044 |
| .034 | 2.13 | .090 | .0049 | .0047 |
| .002 | 1.59 | .073 | .0047 | .0062 |
| .014 | 1.66 | .074 | .0040 | .0053 |
| .038 | 2.04 | .082 | .0027 | .0045 |
| .162 | 1.92 | .20 | .0022 | .0042 |
| .031 | 2.10 | .092 | .0037 | .0059 |
| .026 | 1.91 | .086 | .0040 | .0044 |
| .022 | 1.47 | .094 | .0076 | .0075 |
| 0 | 1.44 | .10 | .010 | .0084 |
| 0 | 1.48 | .11 | .011 | .0053 |

The data of Table VII relate to the same heats plotted in FIG. 10.

The effect of addition of sufficient columbium to provide at least about 0.025% uncombined columbium in the hot rolled product is confirmed by X-ray diffraction studies. These show that the textures of hot rolled, and cold reduced and annealed, products containing at least about 0.025% uncombined columbium are distinguishable from the textures of comparable products containing less than about 0.025% uncombined columbium.

Figure 5:
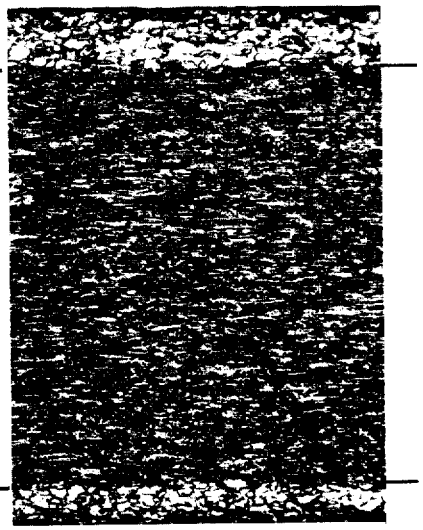
FIGS. 5–9 are photomicrographs at 100x magnification of sections of a steel of the invention showing the mechanism of recrystallization during final annealing.
Figure 6:
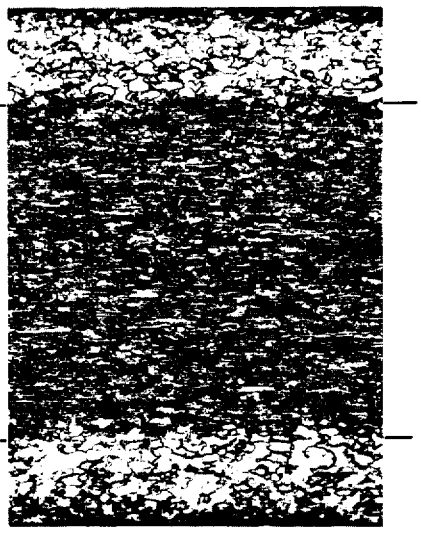
Figure 7:
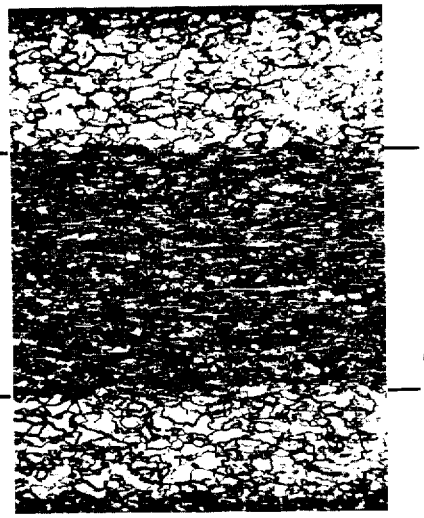

In FIGS. 5-7 the banded structure frequently associated with incomplete recrystallization of the steels of the invention is illustrated. These are etched sections, at 100x magnification, of a mill-produced and processed steel containing 0.11% columbium and 0.005% carbon, hot rolled to 0.100 inch (2.54 mm) thickness, coiled at 1300° F (about 975° K) and cold reduced 65%. The figures show the gradual recrystallization inwardly from the surfaces at 4, 8 and 16 hour stages of an anneal at 1200° F (about 920° K). This very unusual recrystallization response is not explained although it is believed to be caused by the reduced free energy of surface material. This structure is not only a distinguishing characteristic of the steel of this invention, but it also has advantageous aspects. For example, a partially recrystallized product has high strength and formability superior to those of a prior art material which has the same strength due to random recrystallization of the same percentage. In the steel of this invention, the recrystallized grains are at the surfaces where their ductility permits greater elongation of the outer fibers of the section.

Figure 8:
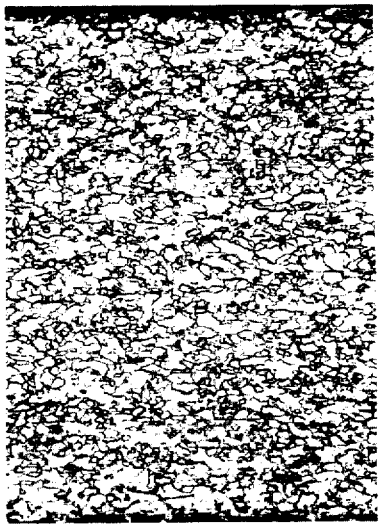
Figure 9:
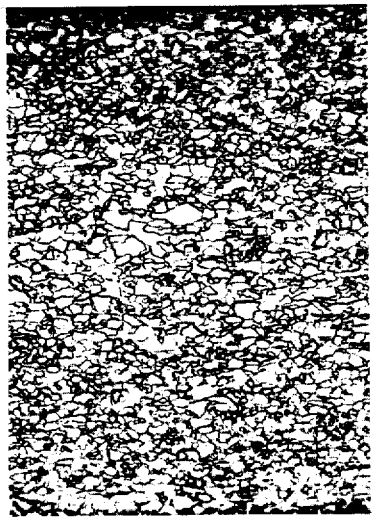

Once the cold reduced structure has recrystallized, it is very stable, as shown in FIGS. 8 and 9 which have been annealed at 1300° F (about 975° K) for 4 hours and 1380° F (about 1020° K) for 8 hours respectively. Mechanical properties of these samples are set forth in Table VIII below.

TABLE VIII

| FIG. | .5% Yield Strength- ksi | .5% Yield Strength- MN/m² | Tensile Strength- ksi | Tensile Strength- MN/m² | % Elong. in 2" | $\bar{r}$ |
|---|---|---|---|---|---|---|
| 5 | 54.0 | 372 | 67.0 | 462 | 18 | 1.00 |
| 6 | 43.0 | 296 | 59.0 | 407 | 26 | 1.17 |
| 7 | 31.0 | 214 | 53.0 | 366 | 32 | 1.54 |
| 8 | 25.0 | 172 | 48.0 | 331 | 40 | 1.94 |
| 9 | 21.0 | 145 | 46.0 | 318 | 44 | 1.92 |

While the preferred practice of the process of the present invention contemplates the step of quenching the hot rolled material from a finishing temperature in the range of 1500° to 1700° F (1090° to 1200° K) to a temperature therebelow at a rate rapid enough to cause precipitation of carbides in finely dispersed form, it will be understood that the scope of the invention is not so limited and covers a product not produced in this manner which nevertheless is fully stable by reason of the columbium addition, and which has great and particular utility for drawing and/or stretching applications, enameling, metallic coating and other uses where good ductility, absence of critical grain growth, aging and yield point elongation are required.

The embodiments of the invention in which an exclusive property or privilege is claimed are defined as follows:

1. A process of producing low carbon steel hot rolled strip and sheet stock having no yield point elongation, freedom from critical grain growth and enhanced yield strength after straining 20% and heating to high temperature for a short period of time, excellent surface characteristics and substantial freedom from inclusions, which comprises the steps of melting a steel containing a maximum carbon content of about 0.05% by weight; vacuum degassing the melt to obtain a steel consisting essentially of, by weight percent, from about 0.002% to about 0.015% carbon, about 0.05% to about 0.60% manganese, sulfur up to about 0.035%, oxygen up to about 0.010%, nitrogen up to about 0.012%, aluminum up to about 0.080%, phosphorus and silicon in residual amounts, and remainder essentially iron; adding from above about 0.025% to about 0.30% columbium, said columbium being added in an amount sufficient to result in at least 0.025% by weight uncombined columbium at the subsequent hot rolling stage as determined by analysis at room temperature and calculated from the formula $$\%Cb_{uncomb.} = \%Cb_{total} - 7.75\%C_{total} - 6.65\left[\%N_{total} - \frac{\%Al_{acid\ sol.}}{1.93}\right] \text{where} \left[\%N_{total} - \frac{\%Al_{acid\ sol.}}{1.93}\right] > 0,$$

when the amount of aluminum is insufficient to combine with all the nitrogen present in the steel; casting and solidifying the degassed steel; hot rolling the steel to strip and sheet thicknesses and coiling at a temperature up to about 1500° F (1090° K).

2. A process of producing low carbon steel cold rooled strip and sheet stock having substantially no yield point elongation, freedom from critical grain growth in the annealed condition and enhanced yield strength after straining 20% and heating to high temperature for a short period of time, excellent surface characteristics and substantial freedom from inclusions, which comprises melting a steel having a maximum carbon content of about 0.05% by weight; vacuum degassing the melt to obtain a steel consisting essentially of, by weight percent, from about 0.002% to about 0.015% carbon, about 0.05% to about 0.60% manganese, sulfur up to about 0.035%, oxygen up to about 0.010%, nitrogen up to about 0.012%, aluminum up to about 0.080%, phosphorus and silicon in residual amounts, and remainder essentially iron; adding from above about 0.025% to about 0.30% columbium, said columbium being added in an amount sufficient to result in at least 0.025% by weight uncombined columbium at the subsequent hot rolling stage as determined by analysis at room temperature and calculated from the formula $$\% Cb_{uncomb} = \% Cb_{total} - 7.75\% C_{total} - 6.65\left[\% N_{total} - \frac{\% Al_{acid\ sol.}}{1.93}\right] \text{where} \left[\% N_{total} - \frac{\% Al_{acid\ sol.}}{1.93}\right] > 0,$$

when the amount of aluminum is insufficient to combine with all the nitrogen present in the steel; casting and solidifying the degassed steel; hot rolling the steel to strip and sheet thicknesses; coiling at a temperature up to about 1500° F (1090° K); removing hot mill scale from the surface of the hot rolled material; and cold rolling the material substantially to final thickness.

3. A process of producing low carbon steel hot rolled strip and sheet stock having no yield point elongation, freedom from critical grain growth and enhanced yield strength after straining 20% and heating to high temperature for a short period of time, excellent surface characteristics and substantial freedom from inclusions, which comprises the steps of melting a steel containing a maximum carbon content of about 0.05% by weight, vacuum degassing the melt to obtain a steel consisting essentially of, by weight percent, from about 0.002% to about 0.015% carbon, about 0.05% to about 0.60% manganese, sulfur up to about 0.035%, oxygen up to about 0.010%, nitrogen up to about 0.012%, phosphorus and silicon in residual amounts, and remainder essentially iron; adding up to about 0.080% aluminum, said aluminum being in an amount sufficient to combine with all the nitrogen present in the steel; adding from above about 0.025% to about 0.30% columbium, said columbium being added in an amount sufficient to result in at least 0.025% by weight uncombined columbium at the subsequent hot rolling stage as determined by analysis at room temperature and calculated from the formula $$\%Cb_{uncomb.} = \%Cb_{total} - 7.75\%C_{total},$$

casting and solidifying the degassed steel; hot rolling the steel to strip and sheet thicknesses and coiling at a temperature up to about 1500° F (1090° K).

4. A process of producing low carbon steel cold rolled strip and sheet stock having substantially no yield point elongation, freedom from critical grain growth in the annealed condition and enhanced yield strength after straining 20% and heating to high temperature for a short period of time, excellent surface characteristics and substantial freedom from inclusions, which comprises melting a steel having a maximum carbon content of about 0.05% by weight; vacuum degassing the melt to obtain a steel consisting essentially of, by weight percent from about 0.002% to about 0.015% carbon, about 0.05% to about 0.60% manganese, sulfur up to about 0.035%, oxygen up to about 0.010%, nitrogen up to about 0.012%, phosphorus and silicon in residual amounts, and remainder essentially iron; adding up to about 0.080% aluminum, said aluminum being in an amount sufficient to combine with all the nitrogen present in the steel; adding from above about 0.025% to about 0.30% columbium, said columbium being added in an amount sufficient to result in at least 0.025% by weight uncombined columbium at the subsequent hot rolling stage as determined by analysis at room temperature and calculated from the formula $$\%Cb_{uncomb.} = \%CB_{total} - 7.75\%C_{total},$$

casting and solidifying the degassed steel; hot rolling the steel to strip and sheet thicknesses; coiling at a temperature up to about 1500° F (1090° K); removing hot mill scale from the surface of the hot rolled material; and cold rolling the material substantially to final thickness.

5. The process of claim 4, wherein the hot rolled material is quenched and coiled at a temperature of from about 940° to about 1300° F (780° to 975° K), and wherein the cold rolled strip is annealed at a temperature of from about 1200° to about 1400° F (920° to 1035° K), whereby to obtain a product having a yield strength ranging from about 20,000 to about 90,000 psi (138 to 620 $MN/m^2$).

* * * * *